US005588180A

United States Patent [19]

Chester

[11] Patent Number: 5,588,180

[45] Date of Patent: Dec. 31, 1996

[54] HINGE

[75] Inventor: Brian Chester, Potts Point, Australia

[73] Assignee: Trychest Proprietary Limited, Potts Point, Australia

[21] Appl. No.: 293,706

[22] Filed: Aug. 22, 1994

[51] Int. Cl.[6] ..... E05D 1/00

[52] U.S. Cl. ..... 16/225; 16/366; 16/386; 16/DIG. 13

[58] Field of Search ..... 16/225, 224, 273, 16/274, 366, 385, 386, 387, DIG. 13

[56] References Cited

U.S. PATENT DOCUMENTS

| | | | |
|---|---|---|---|
| 2,978,020 | 4/1961 | Paulsrude | 16/225 |
| 3,148,724 | 9/1964 | Chieger et al. | 160/231.2 |
| 3,326,268 | 6/1967 | Dixon | 160/231.2 |
| 4,828,132 | 5/1989 | Francis, Jr. et al. | 16/225 |

FOREIGN PATENT DOCUMENTS

| | | | |
|---|---|---|---|
| 2106356 | 8/1971 | Germany | 16/225 |
| 2133457 | 7/1984 | United Kingdom | 16/225 |

*Primary Examiner*—Chuck Y. Mah
*Attorney, Agent, or Firm*—Smith-Hill and Bedell

[57] ABSTRACT

A hinge (1) for locating between two members which are to be folded together and opened apart, comprises a pair of parallel trunnions (2,3) interconnected by spaced webs (4). Each trunnion has axially-spaced cylindrical portions (5) of larger diameter than coaxially-arranged intermediate cylindrical portions (6). The hinge is made of a stiffly resilient plastics material having self-lubricating properties and is mounted between the members with the trunnions located rotatably in respective moulded sockets in the respective members. The webs (4) pass through openings in the end faces of the members and permit them to move in their own planes as well as to rotate during their movement from folded-together positions, to the positions they occupy when they are opened apart. The hinge provides a tidy, clean appearance to the members where they are hinged together.

9 Claims, 2 Drawing Sheets

HINGE

FIELD OF THE INVENTION

THIS INVENTION relates to a hinge and is more specifically concerned with a hinge of clean appearance and which may be used to allow two members to move from a position at which they are alongside one another, to a position at which they are set at a required angle to one another.

STATE OF THE ART

The development of modular furniture made from plastics materials has allowed designers to take advantage of the smooth and clean appearance of plastics to produce articles of aesthetically pleasing appearance.

It is desirable to make large plastics articles, such as modular tables, from parts which can be folded so that the article can be stored and transported in a compact condition.

The conventional design of hinge for enabling two members to be folded together is exemplified in the disclosure of Australian Patent No. 609,136. This design involves the use of plates which are screwed to the members and are formed beyond the ends of the members with collars which alternate with one another. A hinge pin extends through the collars and provides an axis about which the members can be moved from a folded configuration at which they lie alongside one another to an extended configuration at which the members make an angle with one another by an amount determined by opening the hinge to its fullest extent.

A disadvantage with a hinge as described above is that it is invariably made of metal for strength, and has exposed parts which detract from the smooth and uncluttered appearance which a designer normally wishes an article made from plastics to have.

OBJECT OF THE INVENTION

An object of this invention is the provision of an improved hinge.

THE INVENTION

In accordance with the present invention an assembly has two members permanently hinged to one another to permit their movement from a folded configuration at which side faces of the members lie alongside one another to an extended configuration at which they form an angle with one another, the hinge comprising a rigid one-piece, hinging element integrally formed with two axially parallel trunnions joined by an intervening bar and each socketed in a respective member in a manner which allows rotation of the member about the axis of the trunnion, the members having adjacent the hinge respective elongated edge faces which abut one another when the members are in their extended configuration and which form an angle with one another when the members are in their folded configuration the bar interconnecting the trunnions extending through openings formed partly in the side and edge faces of the members and which are shaped to allow angular displacement of the bar about an axis extending parallel and lying between the axes of respective trunnions.

Movement of the members between their folded and extended configurations, is accompanied by rotation of each member about the axis of its respective trunnion, and by angular movement of the bar extending between the two trunnions.

An advantage of the invention is that it is capable of providing a rugged hinge of pleasing appearance because the two trunnions can be socketed inside the respective members so that the only portion of the hinge which is visible, is the bar extending between the trunnions. Such a form of hinge is particularly well suited for interconnecting flat and upright leg portions of a table. The bar is suitably a web.

PREFERRED FEATURES OF THE INVENTION

Preferably the hinging element is made from a moulded plastics material which is tough and self-lubricating, by an integral moulding process. It is preferred that several spaced webs extend between the two trunnions to give the hinging element a ladder-like appearance. The trunnions are suitably made from a material which is tough and smooth and has a low sliding fiction in its socket in the member so that the member can rotate smoothly about its trunnion, during movement of the members between their folded and extended configurations. In one particularly advantageous arrangement each trunnion comprises a set of axially spaced cylindrical sections of different diameter, alternate sections being joined to respective webs and being of larger diameter than the remaining trunnion sections.

Advantageously, a claw having a convex surface bears on the ends of each of the cylindrical trunnion sections of larger diameter, and extends half-way across the gap separating the two end faces of the members in the zone of the hinge axis. The claws provide a degree of protection to prevent contaminants entering the sockets containing the trunnions. They also prevent material accumulating in zones of the hinge at which they could interfere with its operation.

INTRODUCTION TO THE DRAWINGS

The invention will now be described in more detail, by way of example, with reference to the accompanying diagrammatic drawings in which:

IN THE DRAWINGS

DESCRIPTION OF PREFERRED EMBODIMENT

Figure 1:
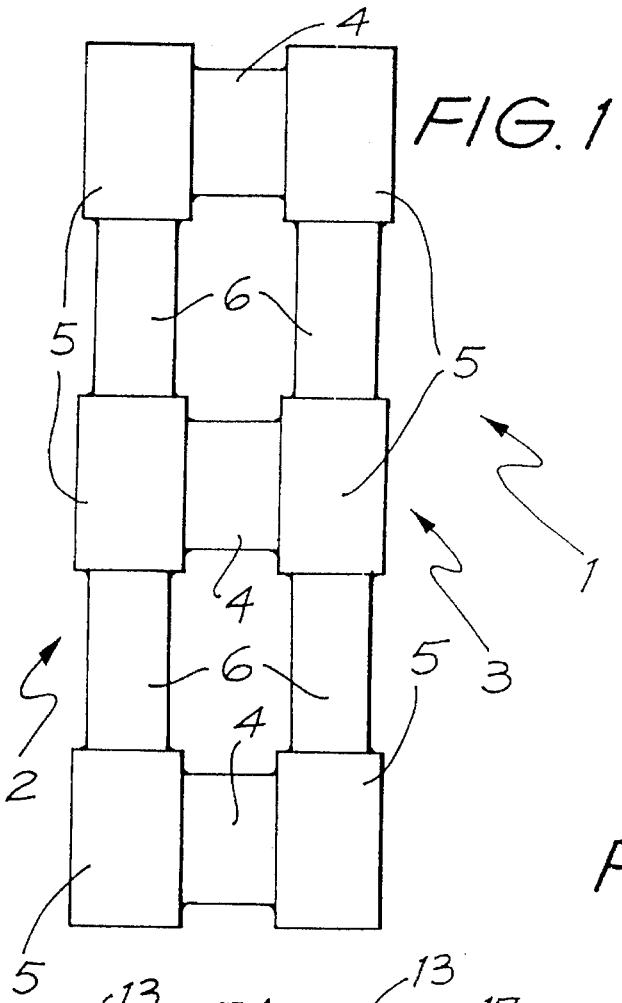
FIG. 1 is a face elevation of a hinging element.
Figure 2:
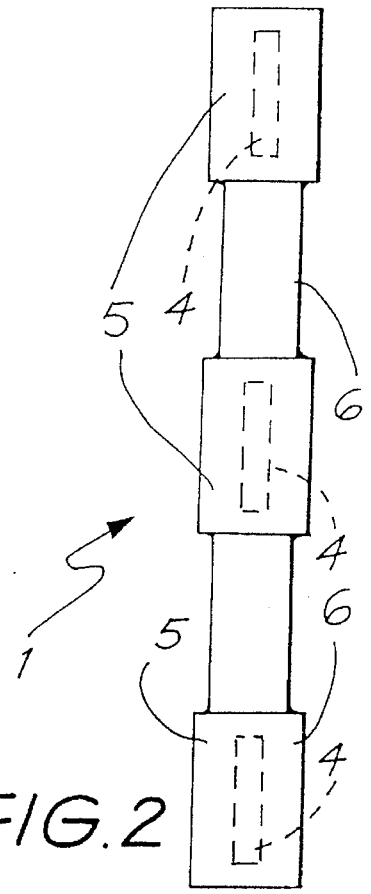
FIG. 2 is an end elevation of the hinging element.

Referring to FIGS. 1 and 2, a one-piece hinging element 1 made of plastics material which is rigid and strong, is formed by two parallel trunnions 2, 3 spaced from one another and interconnected by three parallel webs 4 which are integrally moulded with the trunnions. Each trunnion comprises three sections of relatively large diameter 5 alternating with two sections of smaller diameter 6. The hinging element is integrally moulded from a plastics material currently available in Australia and which is both tough and self-lubricating as well as being resilient.

Figure 3:
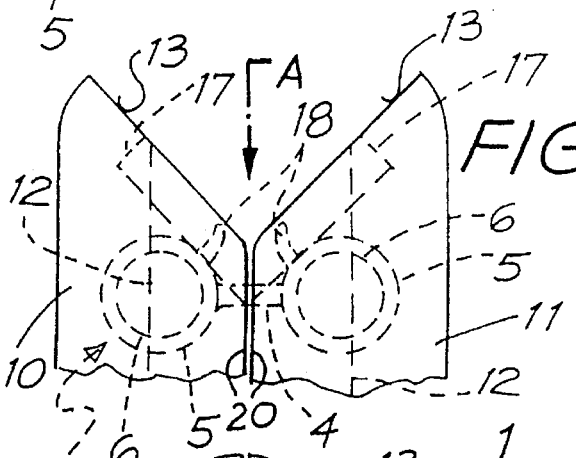
FIG. 3 is a detail of an assembly comprising two members connected by the hinging element and which are shown in their folded configuration.
Figure 4:
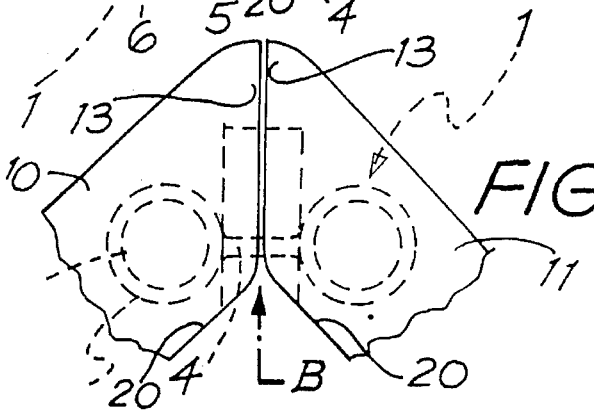
FIG. 4 shows the members of FIG. 3 in their extended configuration.
Figure 5:
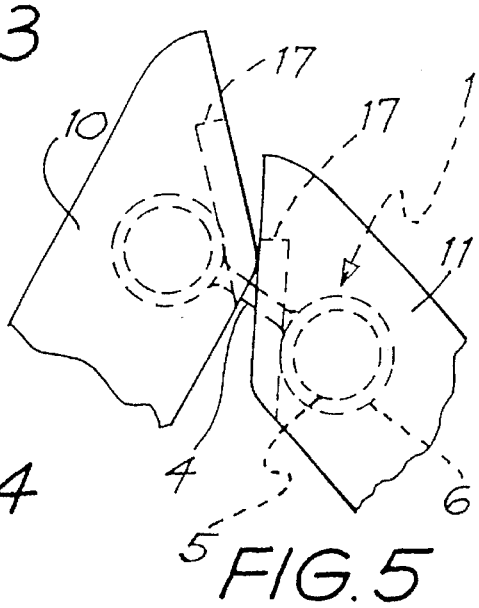
FIG. 5 shows the members of FIGS. 3 and 4 in an intermediate position occupied while moving between their folded and extended configurations.

FIGS. 3, 4 and 5 show how a pair of members 10, 11 are joined to one another at one pair of ends by axially spaced hinging elements 1. Each of the members 10, 11 is formed from two shells which are glued to one another along their medial line 12.

Figure 6:
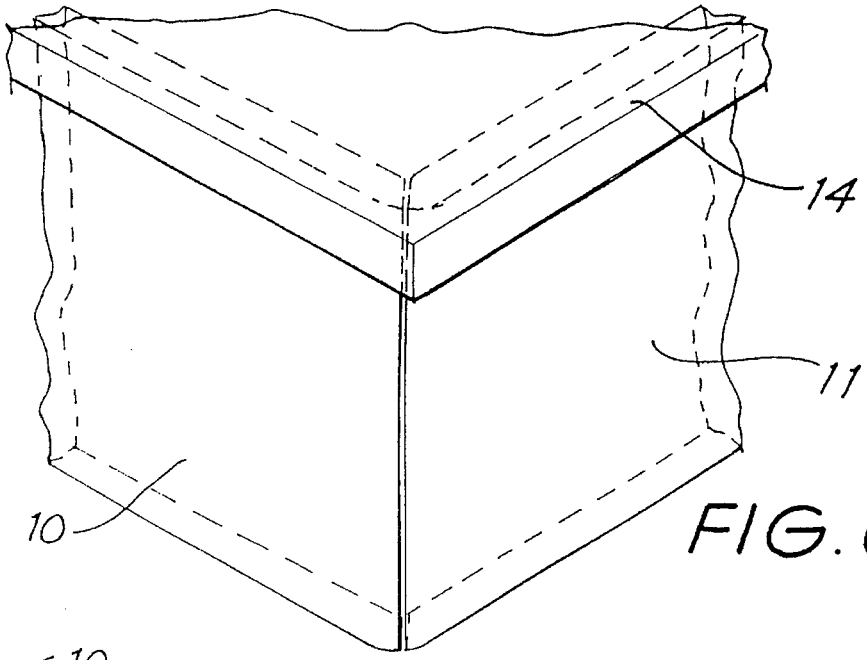
FIG. 6 is a perspective view of a corner of a table having its legs formed by two pairs of members one pair being shown in the perspective view of the figure.

Each member has an edge face 13 extending between two parallel side faces 20. These edge faces lie against one another, as shown in FIG. 4, when the two members 10 and 11 extend perpendicular to one another as illustrated. When the members 10, 11 extend alongside one another, as shown in FIG. 3, their side faces 20 extend next to one another and are parallel. The angle the members 10, 11 make with one another when in the extended configuration, can vary to suit the purpose intended. In the present case, as shown in FIG. 6, the two members form adjacent leg portions of a table of box-like appearance and having an upper horizontal plastic surface 14 which rests beneath its upper peripheral edges on the upper surfaces of the two members 10 and 11 which make an angle of 90 degrees with one another in the particular configuration illustrated. Returning to FIGS. 3, 4 and 5 it will be seen that the end portions of the members 10, 11 adjacent to the hinge are each formed with a socket in which respective trunnions are a snug fit. The edge and side faces 13 are formed with parts of rectangular openings 17 through which the webs 4 extend across the hinge, and which open into the respective trunnion sockets.

Figure 7:
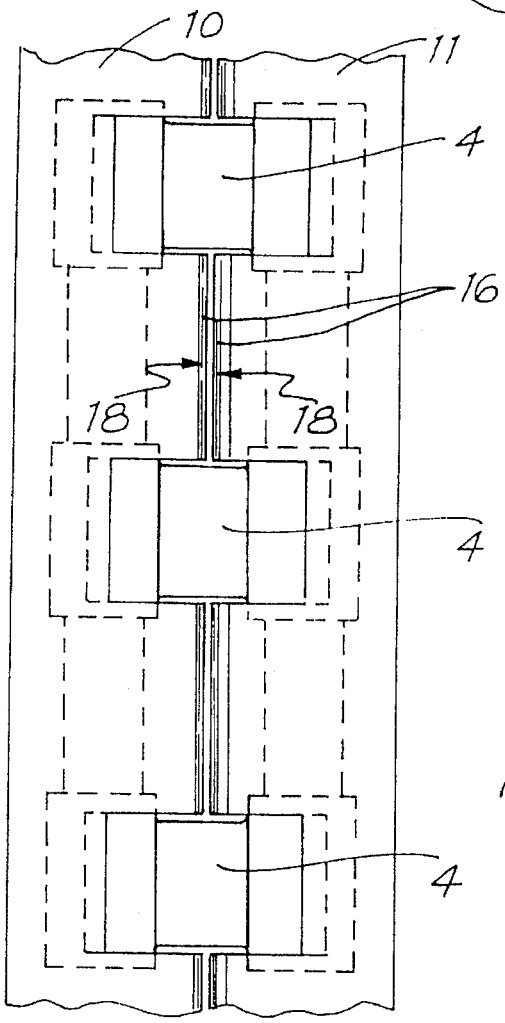
FIG. 7 is a scrap view of the two member shown in FIG. 3 as seen in the direction of the arrow A.
Figure 8:
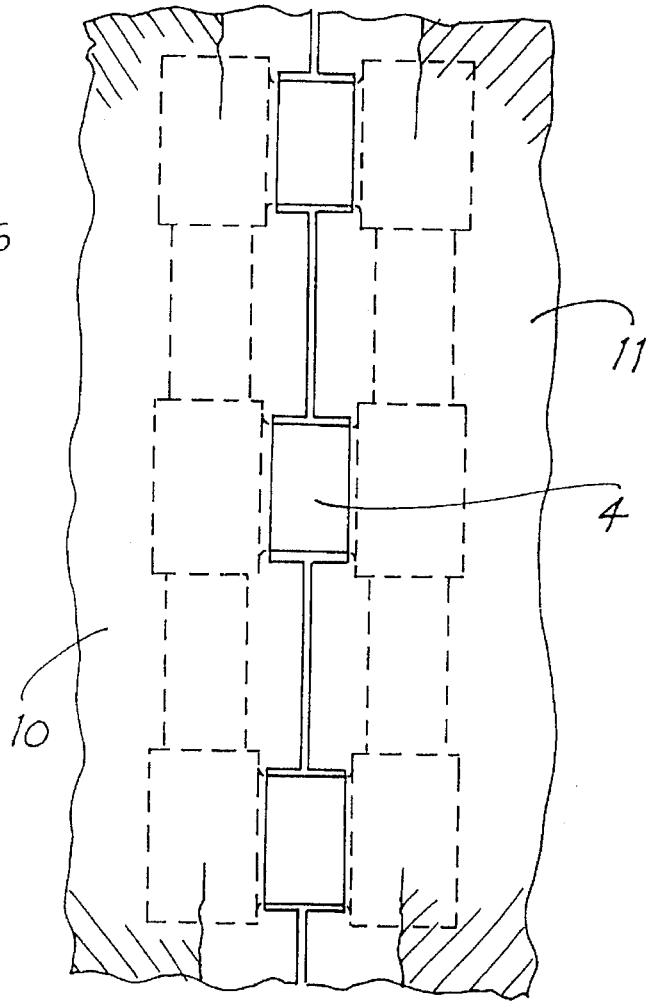
FIG. 8 is a scrap view showing the two members of FIG. 4 as seen in the direction of the arrow B in that figure.

As is apparent from FIGS. 7 and 8, the hinge between the members is provided with opposed claws 18 which extend towards one another to improve the appearance of the inside of the hinged joint formed between the two members 10, 11 when in their extended configuration. FIGS. 7 and 8 also show that the axial length of each large diameter section 5 of each trunnion is greater than the length parallel to the edge faces 20 of the opening through which the web 4 connected to the section 5 extends, whereby the socket completely surrounds part of the axial length of the trunnion. The cross-sectional shapes of the claws 18 are such that they do not touch one another when the members 10, 11 are moved between their extended configuration shown in FIG. 4, and their other or folded configuration shown in FIG. 3.

OPERATION OF PREFERRED EMBODIMENT

As is apparent from FIG. 3, when the side faces 20 of the members 10 and 11 extend alongside one another, the webs 4 extend perpendicular to the planes of the members 10 and 11 and pass through the portions of the openings 17 formed in the side faces.

FIG. 5 shows how, during movement of the members 10, 11 towards their extended configuration, the openings 17 allow the webs 4 to displace angularly about an axis extending parallel to and between the trunnions to allow the members to move towards the position shown in FIG. 4 at which the common plane of the webs 4 extends at 45 degrees to each of the members 10, 11. The outer corners of the members 10, 11 then abut one another so that the outside of the joint present a clean line appearance. During this movement, rotation of each of the members 10, 11 about its respective trunnion also occurs.

I claim:

1. A hinge assembly provided between first and second members having respective side faces permanently hinged to one another to permit their hinging movement relative to one another, each of said members having an elongated edge face and being formed with a socket that opens at its elongated edge face; the hinge assembly comprising a rigid, one-piece, hinging element composed of first and second axially parallel trunnions and at least one intervening bar all integrally formed in said element, said bar being formed as a web and said trunnions each including at least one cylindrical section, the cylindrical sections of respective trunnions being interconnected by said bar and said first and second trunnions being received in said sockets in said first and second members respectively in a manner which allows rotation of each member about the axis of the respective trunnion; the bar interconnecting the trunnions extending through the openings from the sockets, which openings are shaped to allow angular displacement of the bar about an axis extending parallel to and lying between the axes of respective trunnions, and wherein the axial length of said one cylindrical section of each trunnion is greater than the length parallel to said elongated edge face of the opening through which the bar extends, whereby the socket completely surrounds part of the axial length of the trunnion.

2. An assembly as claimed in claim 1, in which the rigid hinging element is moulded from a plastics material having self-lubricating properties.

3. An assembly as claimed in claim 1, in which each trunnion includes at least two spaced cylindrical sections of larger diameter separated by a coaxial cylindrical section of smaller diameter, and each larger diameter section of the first trunnion is connected to a larger diameter section of the second trunnion by a bar formed as a web.

4. An assembly as claimed in claim 3, in which each trunnion has two opposite ends and includes three spaced cylindrical sections of larger diameter two of which are located at respective ends of the trunnion.

5. An assembly as claimed in claim 1, in which the sockets are located in the members and the trunnions can rotate within their sockets about their respective axes.

6. A hinge assembly as claimed in claim 5, further comprising at least two such hinging elements that are spaced apart along the elongate edge faces of the members, and in which the members are provided, between the hinging elements, with claws which substantially close gaps between the hinging elements as viewed from the inside of the angle between the members when they occupy their extended configuration.

7. An assembly as claimed in claim 6, in which the members comprise plastics mouldings.

8. A hinge assembly provided between first and second members having respective side faces, said members being permanently hinged to one another to permit their movement from a folded configuration at which the side faces lie alongside one another, to an extended configuration at which the side faces form an angle with one another, each of said members having an elongated edge face that abuts the edge face of the other member when the members are in their extended configuration and forms an angle with the edge face of the other member when the members are in their folded configuration, and each member being formed with a socket that opens partly both at its edge face and at its side face; the hinge assembly comprising a rigid, one-piece, hinging element composed of first and second axially parallel trunions and an intervening bar all integrally formed in said element, said first and second trunions being received in the sockets in the first and second members respectively in a manner which allows rotation of the member about the axis of the respective trunnion; said trunnions each including two spaced cylindrical sections of larger diameter separated by a coaxial cylindrical section of smaller diameter, the larger diameter sections of the first trunnion being connected to the larger diameter sections of the second trunnion by respective bars each formed as a web and extending through the openings from the sockets, which openings are shaped to allow angular displacement of the bar about an axis extending parallel to and lying between the axes of the respective trunnions.

9. A hinge assembly provided between first and second members having respective side faces, said members being permanently hinged to one another to permit their movement from a folded configuration at which the side faces lie alongside one another, to an extended configuration at which the side faces form an angle with one another, each of said members having an elongated edge face that abuts the edge face of the other member when the members are in their extended configuration and forms an angle with the edge face of the other member when the members are in their folded configuration, and each member being formed with at least two sockets that open partly both at the edge face of the member and at its side face and are spaced apart along the edge face of the member; the hinge assembly comprising at least two rigid, one-piece, hinging elements each composed of first and second axially parallel trunnions and an intervening bar all integrally formed in said hinging element, said first and second trunions of each hinging element being received in sockets in the first and second members respectively in a manner which allows rotation of each member about the axis of the respective trunnion; and wherein the bar interconnecting the trunnions of each hinging element extends through the openings from the sockets, which openings are shaped to allow angular displacement of the bar about an axis extending parallel to and lying between the axes of respective trunnions; and in which the members are provided, between the hinging elements, with claws which substantially close gaps between the hinging elements as viewed from the inside of the angle between the members when they occupy their extended configuration.

* * * * *